US009980549B2

(12) United States Patent
Sakuma et al.

(10) Patent No.: US 9,980,549 B2
(45) Date of Patent: May 29, 2018

(54) HAIR DRYER

(71) Applicant: Nidec Corporation, Kyoto (JP)

(72) Inventors: Yuuichi Sakuma, Kyoto (JP); Yoshihiro Uchitani, Kyoto (JP); Shinichi Noda, Kyoto (JP); Takamasa Yamashita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 175 days.

(21) Appl. No.: 14/970,613

(22) Filed: Dec. 16, 2015

(65) Prior Publication Data

US 2016/0213123 A1 Jul. 28, 2016

Related U.S. Application Data

(60) Provisional application No. 62/106,912, filed on Jan. 23, 2015.

(51) Int. Cl.
*A45D 20/12* (2006.01)

(52) U.S. Cl.
CPC ..... *A45D 20/12* (2013.01)

(58) Field of Classification Search
CPC ..... A45D 20/12
See application file for complete search history.

(56) References Cited

U.S. PATENT DOCUMENTS

| | | | |
|---|---|---|---|
| 2,091,510 A | 8/1937 | Lanz | |
| 4,794,225 A | 12/1988 | Maese | |
| 8,256,132 B2 | 9/2012 | Gaillard et al. | |
| 2006/0196075 A1 | 9/2006 | Santhouse et al. | |

FOREIGN PATENT DOCUMENTS

| | | | | |
|---|---|---|---|---|
| JP | 05-228013 A | | 9/1993 | |
| TW | GB 2497192 A | * | 6/2013 | ..... A45D 20/12 |

* cited by examiner

*Primary Examiner* — Jessica Yuen
(74) *Attorney, Agent, or Firm* — Keating & Bennett, LLP

(57) ABSTRACT

A hair dryer includes a fan motor, a heater unit, and a body case arranged to cover the fan motor and the heater unit, and arranged to extend in a front-rear direction around a central axis. The fan motor includes an impeller arranged to rotate about the central axis, and a motor arranged to rotate the impeller. The body case includes an intake case portion including an air inlet, a discharge case portion including an air outlet, and an admission case portion arranged between the air inlet and the air outlet, and including an admission inlet. The intake case portion includes a suction tube portion arranged to extend toward the admission inlet. The intake case portion and the admission case portion are arranged to together define an expansion chamber arranged between the admission inlet and the air inlet and radially outside of the suction tube portion and the admission inlet.

13 Claims, 7 Drawing Sheets

HAIR DRYER

BACKGROUND OF THE INVENTION

1. Field of the Invention

The present invention relates to a hair dryer.

2. Description of the Related Art

In a typical hair dryer, noise is generated by rotation of an impeller arranged to blow air. U.S. Pat. No. 8,256,132 describes a hair dryer including a silencer (a silencer for a drying appliance and a silent hair dryer). The silencer is an expansion-type silencer, and is arranged on an inlet side of an impeller to reduce noise. The hair dryer includes an orifice through which outside air is sucked in, an expansion chamber (a chamber) as the silencer, and an orifice through which the air is sucked into a centrifugal turbofan. Further, for a smooth flow of air, the orifice through which the air is sucked into the impeller is arranged to have a diameter greater than that of the orifice through which the outside air is taken in. In addition, the expansion chamber is arranged to have a diameter greater than that of the orifice through which the air is sucked into the impeller.

However, regarding the hair dryer described in U.S. Pat. No. 8,256,132, focus is not placed on either the magnitude relationship between the diameters of the respective orifices, or the internal structure of the expansion chamber. Accordingly, a sufficient silencing effect is not achieved by the expansion chamber. For example, after passing through the orifice through which the outside air is sucked in, a flow of air is disturbed, resulting in increased air passage resistance. Therefore, increasing the rotation rate of the impeller to achieve a required air volume leads to increased noise. If the air passage resistance is increased as described above, a part of a silencing effect to be achieved by the expansion-type silencer is not sufficiently achieved.

SUMMARY OF THE INVENTION

According to a preferred embodiment of the present invention, there is provided a hair dryer arranged to send air forward along a central axis extending in a front-rear direction, the hair dryer including a fan motor, a heater unit, and a hollow tubular body case arranged to cover the fan motor and the heater unit, and arranged to extend in the front-rear direction around the central axis. The fan motor includes an impeller arranged to rotate about the central axis, and a motor arranged to rotate the impeller. The body case includes an intake case portion including an air inlet; a discharge case portion including an air outlet; and an admission case portion arranged between the air inlet and the air outlet, and including an admission inlet passing therethrough in a direction parallel to the central axis. The intake case portion includes a tubular suction tube portion arranged to extend forward from a rear end portion thereof toward the admission inlet. The intake case portion and the admission case portion are arranged to together define an expansion chamber arranged between the admission inlet and the air inlet and radially outside of the suction tube portion and the admission inlet. The suction tube portion includes a first opening being a rear opening of the suction tube portion, and a second opening being a front opening of the suction tube portion.

According to the above preferred embodiment of the present invention, noise caused by rotation of the impeller is repeatedly reflected within the expansion chamber, making it less likely for the noise to propagate out of the hair dryer. This reduces noise of the hair dryer. In particular, the suction tube portion provided in the intake case portion contributes to increasing an effect of reverberation of the noise within the expansion chamber. This in turn contributes to more effectively preventing noise from propagating out of the hair dryer.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

It is assumed herein that a direction along a central axis of a motor is defined as a front-rear direction, and that a side on which an air outlet is defined and a side on which an air inlet is defined are defined as a front side and a rear side, respectively. The shape of each member or portion and relative positions of different members or portions will be described based on the above assumptions. It should be noted, however, that the above definitions of the front-rear direction and the front and rear sides are not meant to restrict in any way the orientation of a hair dryer according to any preferred embodiment of the present invention when in use. It is also assumed herein that directions parallel to or substantially parallel to the central axis of the motor are referred to by the term "axial direction", "axial", or "axially", that radial directions centered on the central axis are simply referred to by the term "radial direction", "radial", or "radially", and that a circumferential direction about the central axis is simply referred to by the term "circumferential direction", "circumferential", or "circumferentially". The "cross-sectional area" of an opening or a through hole refers to a cross-sectional area thereof as measured on a plane perpendicular to the central axis.

Figure 1:
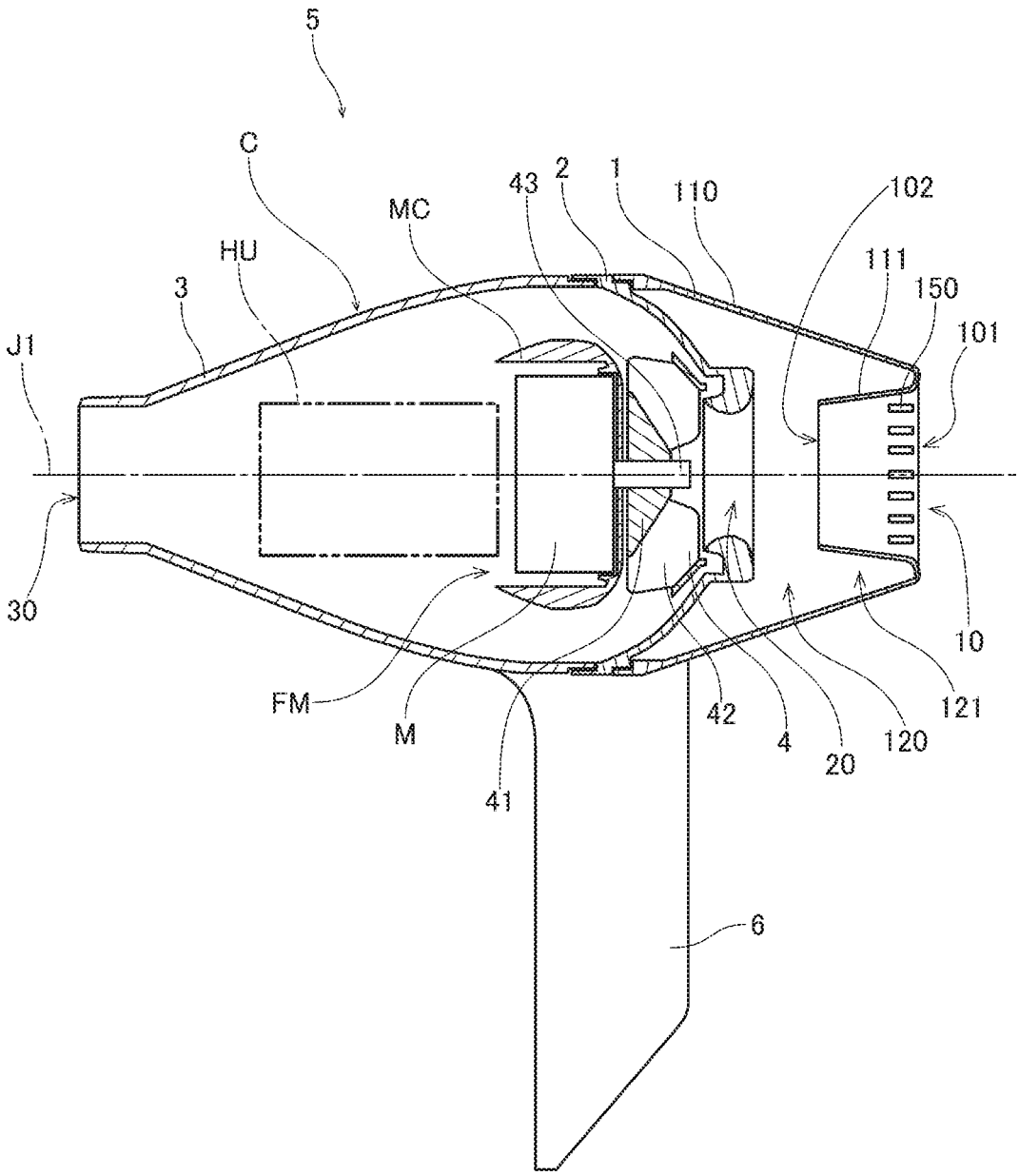
FIG. 1 is a vertical cross-sectional view of a hair dryer according to a preferred embodiment of the present invention.

FIG. 1 is a vertical cross-sectional view of a hair dryer 5 according to an exemplary preferred embodiment of the present invention. The hair dryer 5 is an apparatus arranged to send air forward along a central axis J1 by rotating an impeller 4 through power of a motor M. The hair dryer 5 is used as, for example, a household hair drier or a hair drier for professional use to dry hair.

Referring to FIG. 1, the hair dryer 5 according to the present preferred embodiment includes a fan motor FM, a heater unit HU, a body case C, and a handle portion 6. The fan motor FM includes the impeller 4, which is arranged to rotate about the central axis J1, the motor M, which is arranged to rotate the impeller 4, and a motor case MC arranged to hold the motor M. The fan motor FM according to the present preferred embodiment is a centrifugal fan.

The impeller 4 is arranged to generate an air flow by rotating about the central axis J1. The impeller 4 is arranged radially inside of the body case C. Referring to FIG. 1, the impeller 4 includes a base portion 41 arranged in a center thereof, and a plurality of blades 42 arranged to extend radially outward from the base portion 41. The base portion 41 is fixed to a shaft 43 of the motor M, which will be described below. The blades 42 are arranged in a circumferential direction on a radially outer side of the base portion 41.

The base portion 41 and the blades 42 are integrally defined by a resin injection molding process, for example. Note that the impeller 4 may alternatively be defined by a plurality of members. For example, the base portion 41 and the blades 42 may be separate members. Also note that the impeller 4 may alternatively be made of a material other than resins.

The motor M is a power source to supply power for rotation to the impeller 4. In the hair dryer 5, the motor M is arranged axially forward of the impeller 4. Note that the motor M may alternatively be arranged axially rearward of the impeller 4. The motor M includes the shaft 43, which is arranged to extend along the central axis J1. Once the motor M is driven, magnetic flux of coils inside the motor M and magnetic flux of a magnet(s) inside the motor M interact to produce a circumferential torque. As a result, the shaft 43 of the motor M is caused to rotate about the central axis J1.

A brushless DC motor, for example, is used as the motor M. The brushless DC motor has a longer life than a comparable brushed motor because the brushless DC motor is free from a deterioration in performance caused by a wear of a brush. In addition, it is easier to change the speed of the brushless DC motor than the speed of an AC motor, and it is also easier to reduce the power consumption of the brushless DC motor than the power consumption of the AC motor. Note, however, that a brushed motor or an AC motor may be used instead of the brushless DC motor.

The motor case MC is a member arranged to hold the motor M axially forward of the impeller 4. The motor case MC is arranged to surround the motor M. An outer circumferential surface of the motor M is arranged to be at least partly in contact with an inner circumferential surface of the motor case MC. The motor M is thus positioned inside of the motor case MC. The air flow generated by the impeller 4 passes through a space radially outside of the motor case MC. An outer circumferential surface of the motor case MC is arranged to once increase in diameter and then decrease in diameter as it extends axially forward from an axially rearward end thereof. That is, the outer circumferential surface of the motor case MC is curved to extend along an opposed portion of an inner circumferential surface of the body case C. This increases efficiency with which the air flow generated by the impeller 4 is sent axially forward around the motor case MC.

The body case C is a hollow tubular case extending in the front-rear direction around the central axis J1. A resin, for example, is used as a material of the body case C. The body case C is arranged to house the fan motor FM and the heater unit HU.

The body case C includes an intake case portion 1, a discharge case portion 3, and an admission case portion 2. The intake case portion 1 includes an air inlet 10 through which air is sucked from an external space. The discharge case portion 3 includes an air outlet 30 through which the air is discharged to the external space. The admission case portion 2 is arranged between the discharge case portion 3 and the intake case portion 1. In addition, the admission case portion 2 includes an admission inlet 20 arranged between the air inlet 10 and the air outlet 30. The admission inlet 20 is arranged to pass through the admission case portion 2 in a direction parallel to the central axis J1. The impeller 4 is arranged radially inside of the admission case portion 2. An inner circumferential surface of the admission case portion 2 is arranged in proximity to an outer end portion of the impeller 4. This contributes to preventing a backflow of gas through a gap between the inner circumferential surface of the admission case portion 2 and the impeller 4.

The intake case portion 1 includes a tubular suction tube portion 111 arranged to extend forward from a rear end portion thereof toward the admission inlet 20. The suction tube portion 111 includes a first opening 101, which is a rear opening thereof, and a second opening 102, which is a front opening thereof. The first opening 101 and the second opening 102 are through holes, and are arranged to join the external space, i.e., a space outside of the body case C, and an interior space of the body case C to each other. In the present preferred embodiment, an impeller guard portion 150 is provided in the air inlet 10 to prevent a human finger or the like from touching the impeller 4.

An expansion chamber 120 is defined by the intake case portion 1 and the admission case portion 2 inside the hair dryer 5. The expansion chamber 120 is arranged between the admission inlet 20 and the air inlet 10 and radially outside of the suction tube portion 111 and the admission inlet 20. In addition, the expansion chamber 120 is arranged to extend in an annular shape along an inner circumferential surface of an intake case tubular portion 110, which will be described below. The radial width of the expansion chamber 120 is arranged to gradually decrease toward a rear end of the expansion chamber 120. In addition, a gas channel leading from the suction tube portion 111 to the admission inlet 20 is defined between the suction tube portion 111 and the admission case portion 2. This gas channel and the expansion chamber 120 are in communication with each other.

The handle portion 6 is a portion to be held by a user of the hair dryer 5 when the user uses the hair dryer 5. The handle portion 6 is arranged to extend radially outward from a region including or near a boundary between the intake case portion 1 and the admission case portion 2 and/or a boundary between the admission case portion 2 and the discharge case portion 3. A switch(es) (not shown) is provided in the handle portion 6 to allow the user to turn on and off the hair dryer 5 or adjust the power of the hair dryer 5. In the present preferred embodiment, the intake case portion 1, the discharge case portion 3, and the handle portion 6 are defined by separate members. Note, however, that the intake case portion 1, the discharge case portion 3, and the handle portion 6 may alternatively be defined by a single monolithic member.

Once the motor M is driven, the impeller 4 is caused to rotate. As a result, air flows into the air inlet 10 from the space outside of the body case C. The air, which has flowed into the body case C, passes through a space radially inside of the expansion chamber 120, and is guided to the admission inlet 20. Thereafter, the air is heated by the heater unit HU, which is arranged inside the discharge case portion 3. The air is then discharged out of the body case C through the air outlet 30.

Noise caused by rotation of the impeller 4 is repeatedly reflected within the expansion chamber 120. As a result, the energy of the noise is attenuated. Accordingly, the noise, with its energy lower than the energy of the noise when caused by the rotation of the impeller 4, propagates out of the expansion chamber 120. Thus, noise that propagates out of the hair dryer 5 is reduced. The suction tube portion 111 provided in the intake case portion 1, in particular, causes noise to be easily confined in a gap between the suction tube portion 111 and the intake case portion 1. The suction tube portion 111 thus increases an effect of reverberation of the noise within the expansion chamber 120, more effectively preventing the noise from propagating out of the hair dryer 5.

In the present preferred embodiment, the first opening 101 of the air inlet 10, through which outside air is taken in, is arranged to have a cross-sectional area greater than a cross-sectional area of the second opening 102. In addition, the expansion chamber 120 is defined by the intake case portion 1 and the admission case portion 2. This contributes to preventing the noise caused by the rotation of the impeller 4 from propagating out of the hair dryer 5 through the air inlet 10. Specifically, the noise caused by the rotation of the impeller 4 reverberates within the expansion chamber 120, making it less likely for the noise to propagate out of the hair dryer. As a result, noise of the hair dryer 5 is reduced. In addition, the suction tube portion 111 provided in the intake case portion 1 increases an effect of reduction in noise within the expansion chamber 120, making it less likely for the noise to propagate out of the hair dryer 5 through the air inlet 10. Thus, a silencing effect within the expansion chamber 120 is increased.

Figure 2:
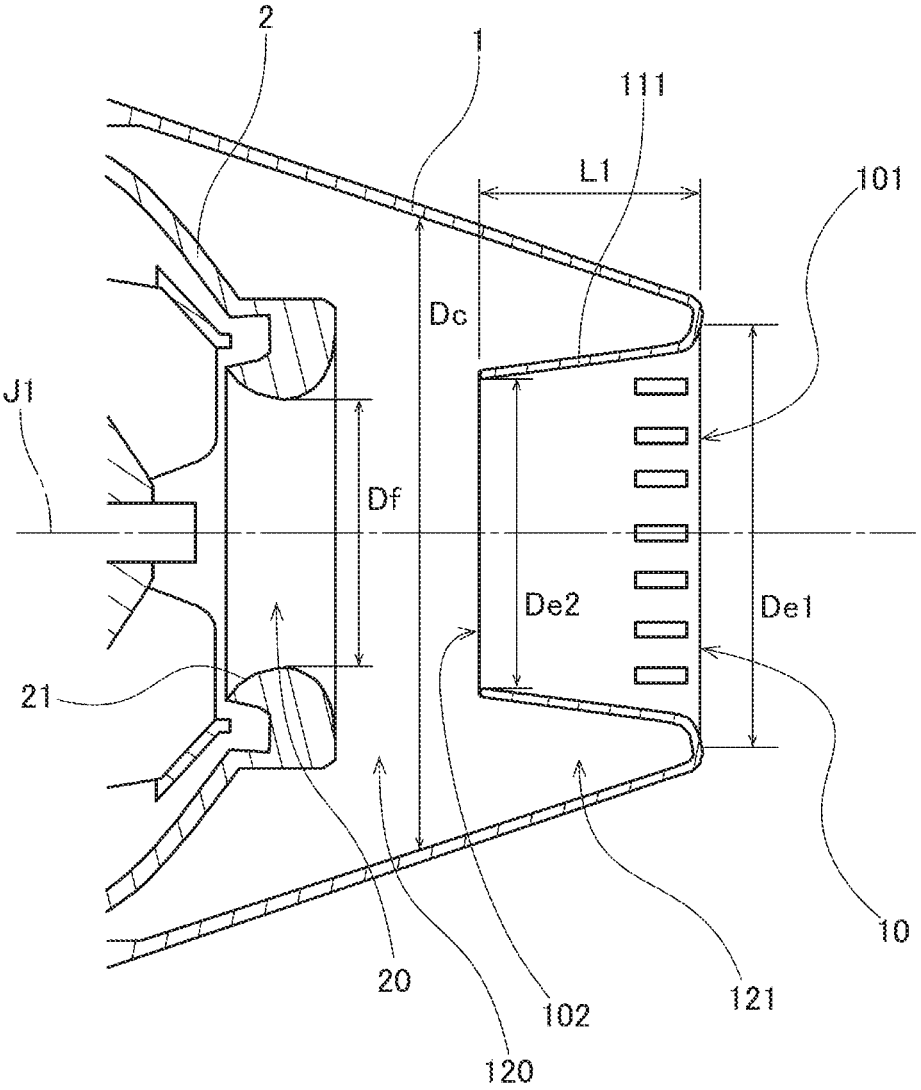
FIG. 2 is a partial cross-sectional view of the hair dryer according to a preferred embodiment of the present invention.

FIG. 2 is an enlarged cross-sectional view illustrating the suction tube portion 111 of the hair dryer 5 and its vicinity. In the present preferred embodiment, each of the first opening 101, the second opening 102, and the admission inlet 20 is circular or substantially circular in shape when viewed in the axial direction. Note that each of the first opening 101, the second opening 102, and the admission inlet 20 may not necessarily be circular or substantially circular in shape. Referring to FIG. 2, a diameter De2 of the second opening 102 is greater than a diameter Df of the admission inlet 20. Further, a diameter (De1) of the first opening 101 is still greater than the diameter De2 of the second opening 102. That is, a cross-sectional area of the second opening 102 is greater than a cross-sectional area of the admission inlet 20, and a cross-sectional area of the first opening 101 is still greater than the cross-sectional area of the second opening 102, each cross-sectional area being measured on a plane perpendicular to the central axis J1. This contributes to reducing air passage resistance for air sucked into the hair dryer 5 from the external space, and also contributes to reducing air passage resistance for the air flowing inside the hair dryer 5. Thus, loads on the motor M and the impeller 4 are reduced.

In particular, in the present preferred embodiment, the cross-sectional area of the first opening 101 is greater than the cross-sectional area of the second opening 102, and an inside diameter of the suction tube portion 111 is arranged to gradually decrease in a forward direction. This contributes to reducing air passage resistance for air inside the suction tube portion 111. As a result, the air smoothly flows through the suction tube portion 111 from the air inlet 10, reducing the noise caused by the rotation of the impeller 4. Moreover, to increase the silencing effect by the expansion chamber 120, the suction tube portion 111 is preferably arranged to have an axial dimension equal to or greater than a radius of the first opening 101. In the present preferred embodiment, the diameter (De1) of the first opening 101 is 1.5 times the axial dimension (L1) of the suction tube portion 111.

The intake case portion 1 includes the intake case tubular portion 110, which is arranged to decrease in an outside diameter toward the air inlet 10 at a rear of the intake case portion 1. The suction tube portion 111 is arranged radially inside of the intake case tubular portion 110. The suction tube portion 111 is arranged to extend in the axial direction from an inner circumferential surface of an air-inlet end of the intake case tubular portion 110 forwardly toward the motor M. The suction tube portion 111 and the intake case tubular portion 110 are arranged radially opposite to each other with a gap 121 therebetween. The gap 121 defines a portion of the expansion chamber 120.

The reverberation effect within the expansion chamber 120 is increased by the aforementioned gradual decrease in the diameter of the intake case tubular portion 110 toward the rear of the intake case portion 1. As a result, a noise reducing effect by the expansion chamber 120 is increased.

Further, in the present preferred embodiment, the admission inlet 20 includes, at least in a portion thereof, a slanting portion 21 arranged to gradually increase in an inside diameter in the forward direction. In addition, the slanting portion 21 is gradually curved radially outward in the forward direction. This contributes to reducing air passage resistance for air in the admission inlet 20.

Furthermore, the fan motor FM is preferably a centrifugal fan or a mixed flow fan. The centrifugal fan and the mixed flow fan can achieve higher static pressure than an axial fan. In addition, at least a portion of the inner circumferential surface of the admission case portion 2 is arranged to extend along a periphery of the impeller 4. Moreover, the inner circumferential surface of the admission case portion 2 is arranged to extend forward while increasing in a diameter as it extends forward from the admission inlet 20 toward the impeller 4. This contributes to reducing eddies caused by an air flow caused by the rotation of the impeller 4 striking the admission case portion 2. This in turn contributes to further reducing the noise of the hair dryer 5.

Thus, air sucked through the air inlet 10 flows into the space radially inside of the expansion chamber 120 while increasing its flow velocity. In addition, occurrence of air passage resistance caused by air turbulence in the course of the air inflow can be reduced. This enables the hair dryer 5 to blow a required volume of air as a high air volume hair dryer. Here, eddies and pressure fluctuations, which are typical causes for noise, primarily occur around the impeller 4. Such noise propagates upstream as well as downstream with respect to the air flow, and the expansion chamber 120 acts to attenuate the energy of the noise. As a result, noise which propagates out of the hair dryer 5 is reduced.

While an exemplary preferred embodiment of the present invention has been described above, it will be understood that the present invention is not limited to the above-described preferred embodiment.

Figure 3:
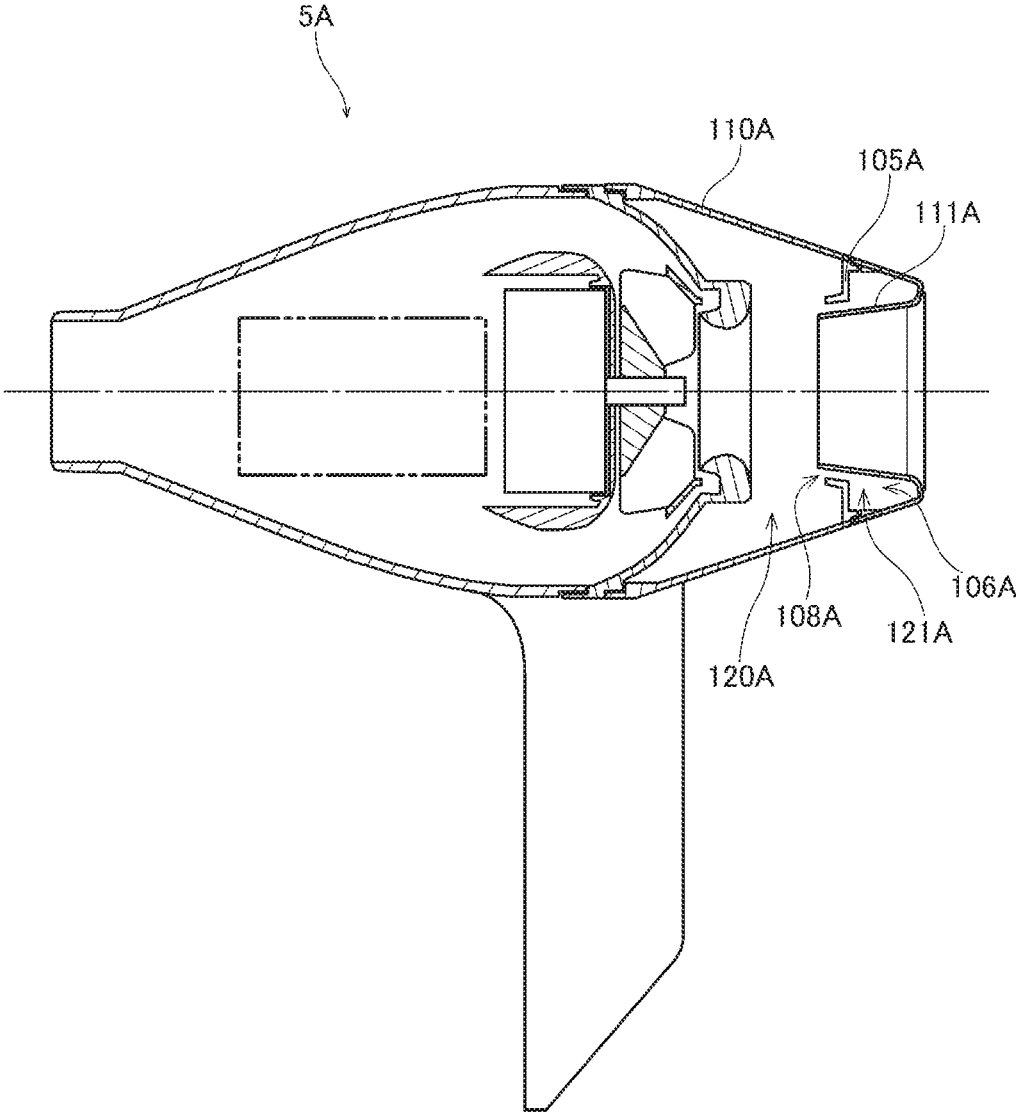
FIG. 3 is a vertical cross-sectional view of a hair dryer according to a modification of the above preferred embodiment of the present invention.

FIG. 3 is a vertical cross-sectional view of a hair dryer 5A according to a modification of the above-described preferred embodiment. The hair dryer 5A illustrated in FIG. 3 is different from the hair dryer 5 according to the above-described preferred embodiment in that a Helmholtz resonator is provided in an expansion chamber 120A. The hair dryer 5A is otherwise similar in structure to the hair dryer 5 according to the above-described preferred embodiment.

An intake case tubular portion 110A of the hair dryer 5A illustrated in FIG. 3 includes an annular portion 105A arranged to extend radially inward. The annular portion 105A is arranged in a gap 121A. In addition, the annular portion 105A includes an opening portion 108A passing therethrough in the axial direction. The opening portion 108A is arranged to join the gap 121A and the expansion chamber 120A to each other. The annular portion 105A and a suction tube portion 111A are arranged radially opposite to each other with the opening portion 108A therebetween. In the modification of FIG. 3, the opening portion 108A defines an annular clearance space between the annular portion 105A and the suction tube portion 111A. That is, the annular portion 105A, the intake case tubular portion 110A, and the suction tube portion 111A together define a volume portion 106A, which is an annular space. Note that the opening portion 108A is a through hole passing through the annular portion 105A in the axial direction and extending over at least a portion of the circumferential extent of the annular portion 105A.

The opening portion 108A and the volume portion 106A are arranged to together define the Helmholtz resonator. The Helmholtz resonator reduces fluctuations of pressure within the expansion chamber 120A, and is thus able to reduce noise caused by air-column resonance or the like in the expansion chamber 120A.

A resonance frequency F of the Helmholtz resonator is given by the following equation:

$$F=C/2\pi\times\sqrt{(S/VL)}. \quad \text{Eq. 1}$$

In the above equation, C is the speed of sound, S is the cross-sectional area of the opening portion 108A, L is the axial dimension (with acoustic correction) of an inner circumferential surface of the opening portion 108A, and V is the volume of the volume portion 106A. Using the above equation, the Helmholtz resonator can be designed in accordance with frequencies of noise to be reduced. For example, if the cross-sectional area S of the opening portion 108A is equivalent to the area of a circle with a diameter of 20 mm, the axial dimension L is 10 mm, the volume V is 10 $cm^3$, and the speed C of sound is 340 m/sec, then the resonance frequency F is about 1500 Hz. The Helmholtz resonator can thus be defined by the suction tube portion 111A and the annular portion 105A inside the hair dryer 5A. The Helmholtz resonator can be easily designed suitably for a range of noise components which are easily augmented in the hair dryer 5A.

Figure 4:
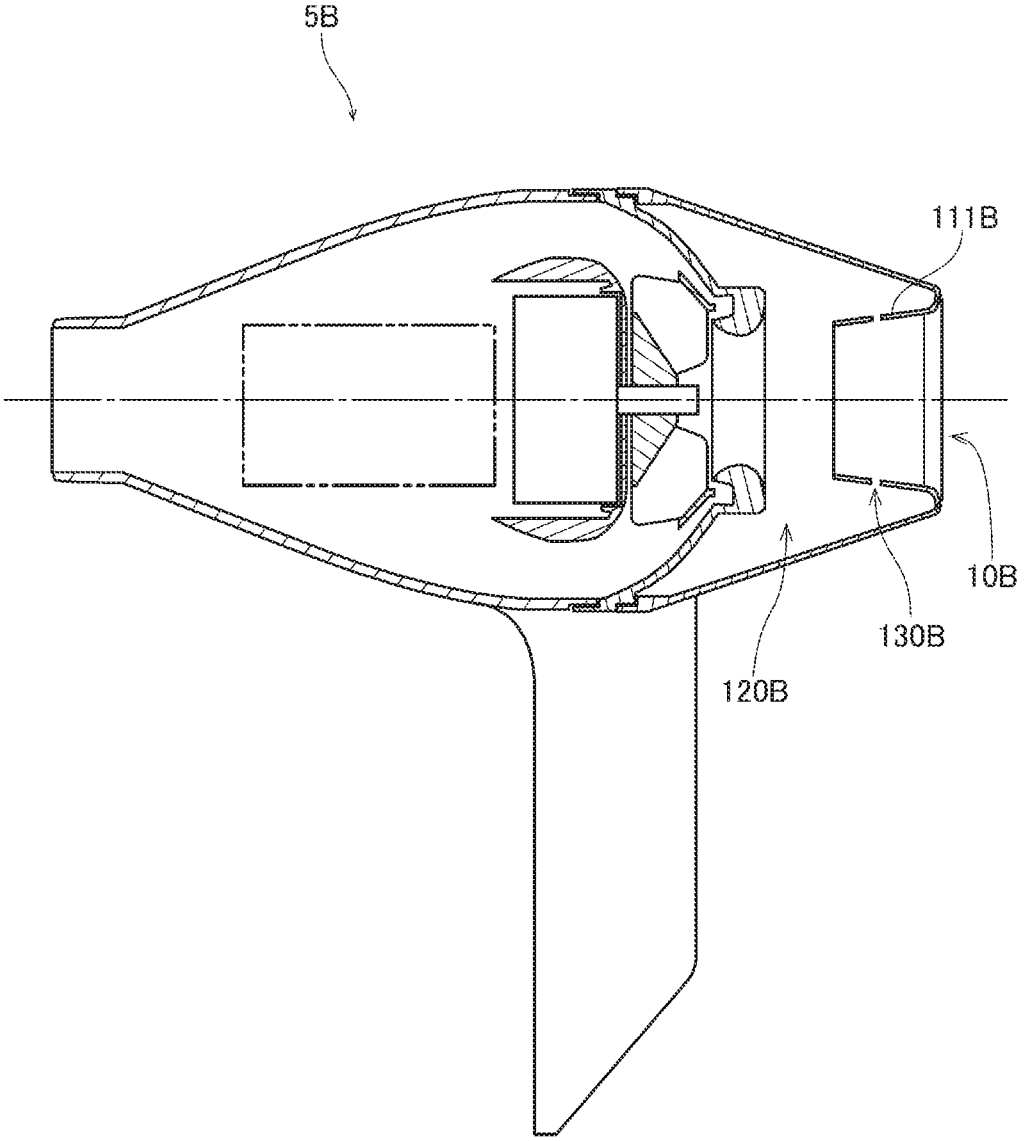
FIG. 4 is a vertical cross-sectional view of a hair dryer according to a modification of the above preferred embodiment of the present invention.

FIG. 4 is a vertical cross-sectional view of a hair dryer 5B according to a modification of the above-described preferred embodiment. The hair dryer 5B illustrated in FIG. 4 is different in structure from the hair dryer 5 according to the above-described preferred embodiment in that a suction tube portion 111B includes minute apertures 130B. Each minute aperture 130B is arranged to pass through the suction tube portion 111B in a radial direction. The minute aperture 130B is arranged to join an air inlet 10B and an expansion chamber 120B to each other. The minute apertures 130B control air fluctuations within the expansion chamber 120B. Thus, the air fluctuations within the expansion chamber 120B are reduced, whereby noise caused by air-column resonance or the like is reduced. Note that, although two minute apertures 130B are provided in the modification of FIG. 4, the number of minute apertures 130B may not necessarily be two.

Figure 5:
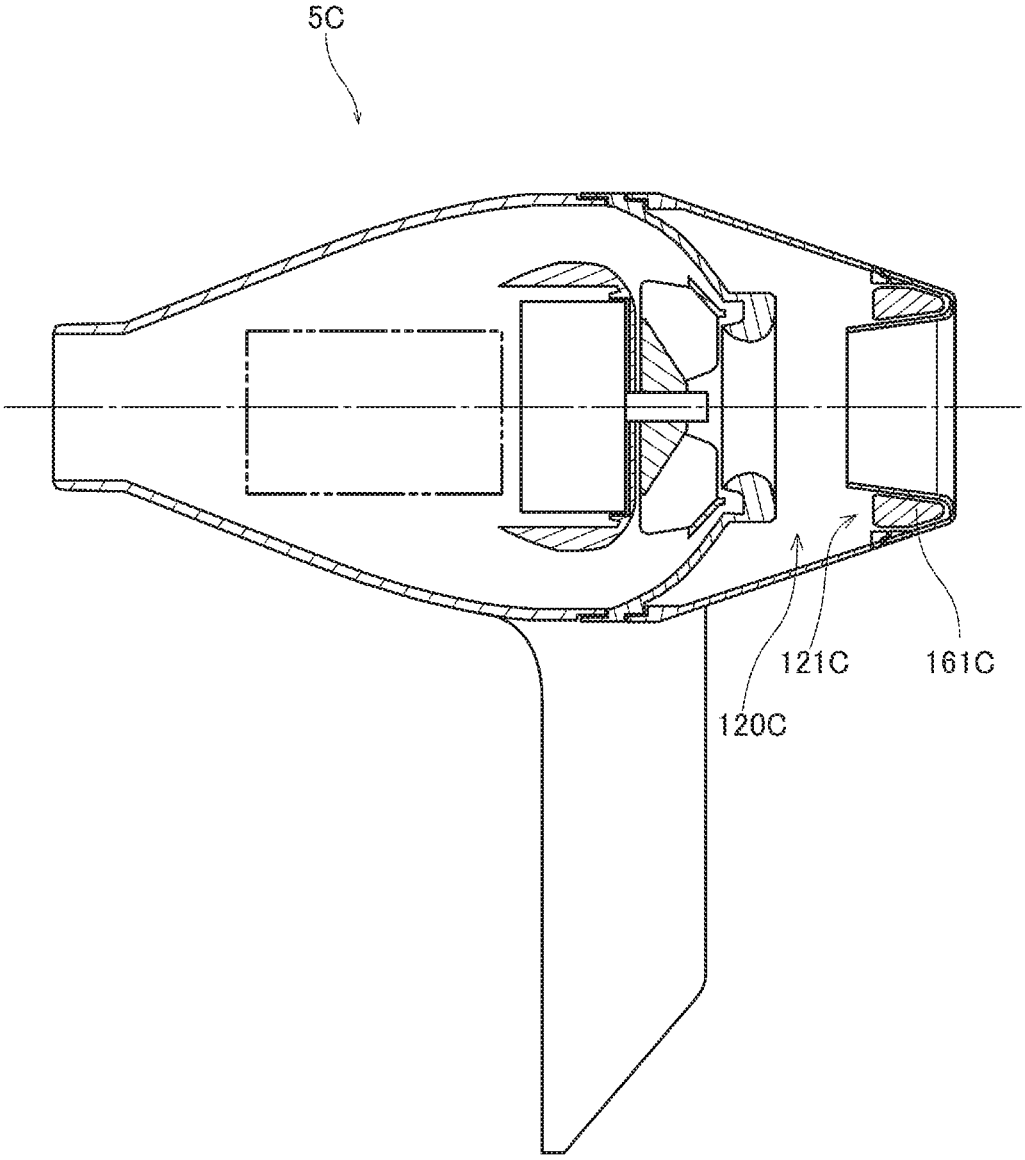
FIG. 5 is a vertical cross-sectional view of a hair dryer according to a modification of the above preferred embodiment of the present invention.

FIG. 5 is a cross-sectional view of a hair dryer 5C according to a modification of the above-described preferred embodiment. The hair dryer 5C illustrated in FIG. 5 is different in structure from the hair dryer 5 according to the above-described preferred embodiment in that a first sound absorber 161C is arranged in a gap 121C. The first sound absorber 161C is made of a material such as, for example, a sponge or glass wool. The first sound absorber 161C absorbs or attenuates high-frequency noise components in an expansion chamber 120C. As a result, noise which propagates out of the hair dryer 5C is further reduced.

Figure 6:
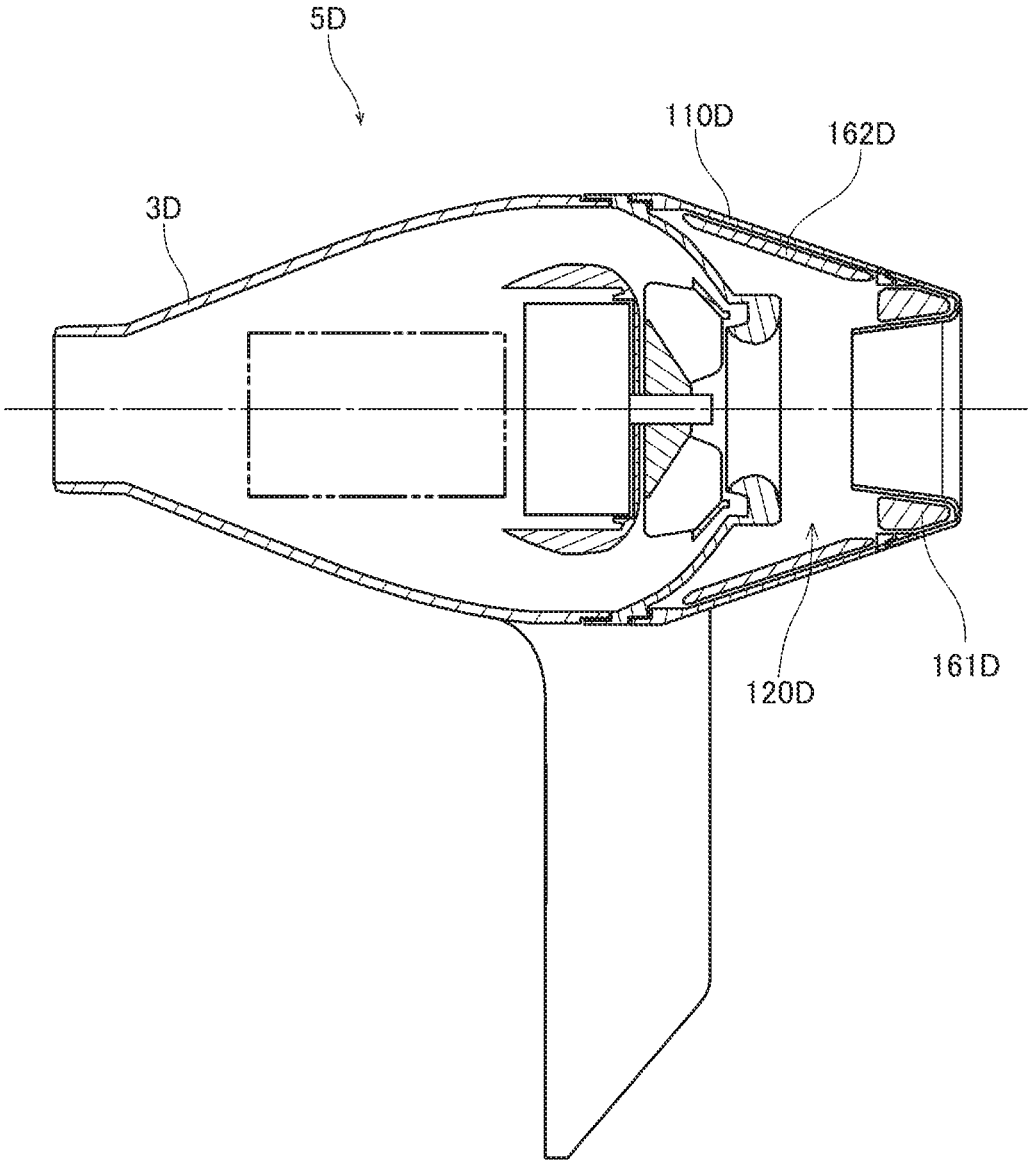
FIG. 6 is a vertical cross-sectional view of a hair dryer according to a modification of the above preferred embodiment of the present invention.

FIG. 6 is a vertical cross-sectional view of a hair dryer 5D according to a modification of the above-described preferred embodiment. The hair dryer 5D illustrated in FIG. 6 is different from the hair dryer 5C illustrated in FIG. 5 in that a second sound absorber 162D is additionally provided on an inner circumferential surface of an intake case tubular portion 110D. The second sound absorber 162D absorbs or attenuates high-frequency noise components. As a result, a silencing effect within an expansion chamber 120D is increased. Note that, in the modification of FIG. 6, the hair dryer 5D includes both a first sound absorber 161D and the second sound absorber 162D. Note, however, that the hair dryer 5D may alternatively include only the second sound absorber 162D. Also note that a sound absorber may be provided inside a discharge case portion 3D.

Figure 7:
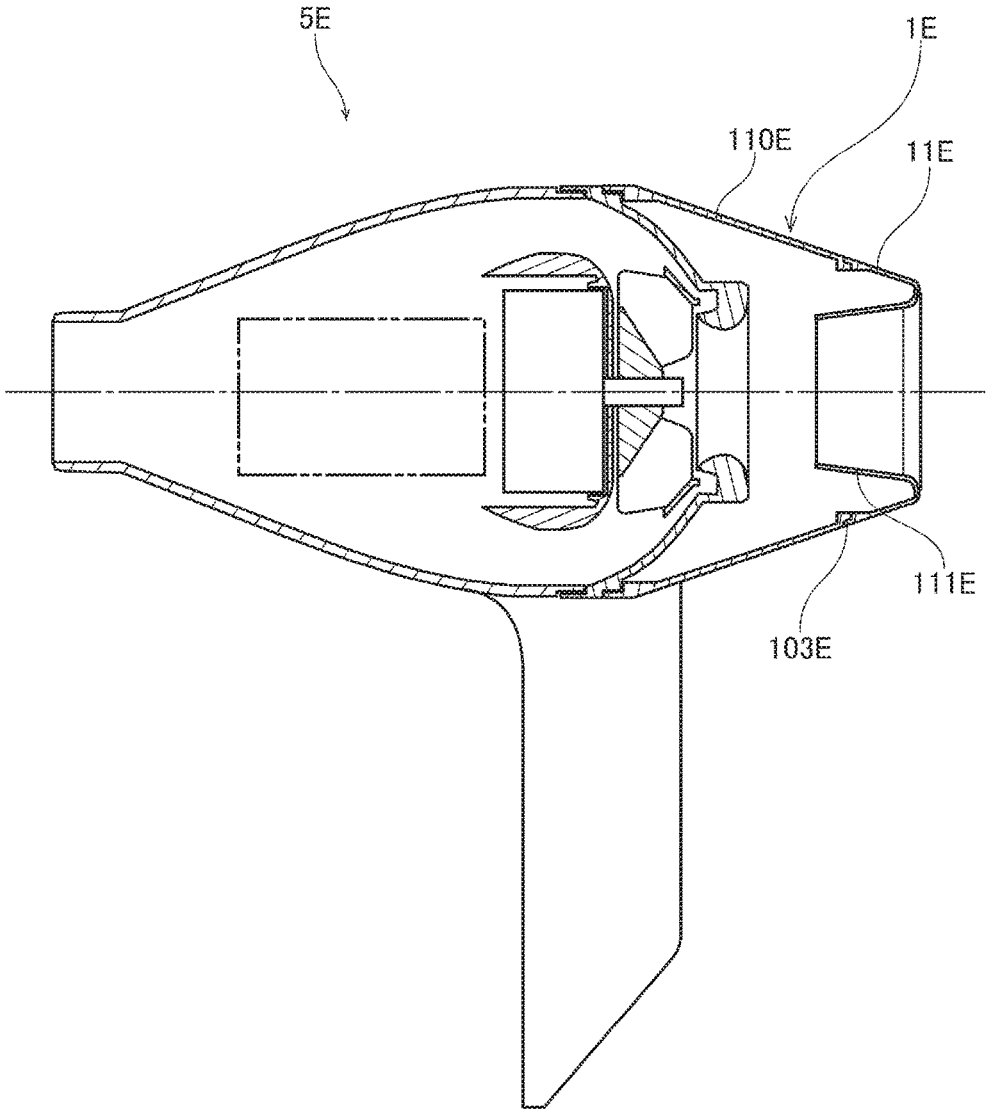
FIG. 7 is a vertical cross-sectional view of a hair dryer according to a modification of the above preferred embodiment of the present invention.

FIG. 7 is a cross-sectional view of a hair dryer 5E according to a modification of the above-described preferred embodiment. The hair dryer 5E illustrated in FIG. 7 is different from the hair dryer 5 according to the above-described preferred embodiment in that an intake case portion 1E is defined by two separate members, an intake case tubular portion 110E and an attachment portion 11E. The intake case portion 1E may thus be defined by a plurality of members.

The attachment portion 11E is provided with a mechanism (not shown) to easily attach and detach the attachment portion 11E to and from the intake case tubular portion 110E. Once the attachment portion 11E is attached to the intake case tubular portion 110E, the attachment portion 11E and the intake case tubular portion 110E are in close contact with each other at a division position 103E. In addition, in the modification of FIG. 7, a suction tube portion 111E is defined by the attachment portion 11E. According to the modification of FIG. 7, cleaning of an interior space of a body case is made easier by detaching the attachment portion 11E from the intake case tubular portion 110E.

Note that the attachment portion 11E or the intake case tubular portion 110E may be provided with an impeller guard portion.

Also note that various modifications can be made to the hair dryer without departing from the scope and spirit of the present invention. For example, a fan motor including an impeller and a motor may be arranged more axially forward than the fan motor in FIG. 1.

Also note that the detailed shape of any member of the hair dryer may be different from the shape thereof as illustrated in the accompanying drawings of the present application. Also note that features of the above-described preferred embodiment and the modifications thereof may be combined appropriately as long as no conflict arises.

Preferred embodiments of the present invention are applicable to, for example, hair dryers.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hair dryer arranged to send air forward along a central axis extending in a front-rear direction, the hair dryer comprising:

a fan motor;

a heater unit; and a hollow tubular body case arranged to cover the fan motor and the heater unit, and arranged to extend in the front-rear direction around the central axis; wherein the fan motor includes:

an impeller arranged to rotate about the central axis; and a motor arranged to rotate the impeller;

the body case includes:

an intake case portion including an air inlet;

a discharge case portion including an air outlet; and an admission case portion arranged between the air inlet and the air outlet, and including an admission inlet passing therethrough in a direction parallel to the central axis;

the intake case portion includes a tubular suction tube portion arranged to extend forward from a rear end portion thereof toward the admission inlet;

the intake case portion and the admission case portion are arranged to together define an expansion chamber arranged between the admission inlet and the air inlet and radially outside of the suction tube portion and the admission inlet; and the suction tube portion includes:

a first opening being a rear opening of the suction tube portion; and a second opening being a front opening of the suction tube portion;

the admission inlet includes, at least in a portion thereof, a slanting portion arranged to gradually increase in an inside diameter in the forward direction; and the slanting portion is gradually curved radially outward in the forward direction.

2. The hair dryer according to claim 1, wherein a cross-sectional area of the first opening is greater than a cross-sectional area of the admission inlet.

3. The hair dryer according to claim 1, wherein a cross-sectional area of the second opening is greater than the cross-sectional area of the admission inlet.

4. The hair dryer according to claim 1, wherein each of the first opening, the second opening, and the admission inlet is circular or substantially circular.

5. The hair dryer according to claim 4, wherein the cross-sectional area of the first opening is greater than the cross-sectional area of the second opening.

6. The hair dryer according to claim 4, wherein an inside diameter of the suction tube portion is arranged to gradually decrease in a forward direction; and an inside diameter of the first opening is greater than an inside diameter of the second opening.

7. The hair dryer according to claim 4, wherein the suction tube portion is arranged to have an axial dimension equal to or greater than a radius of the first opening.

8. The hair dryer according to claim 1, wherein the intake case portion further includes an intake case tubular portion arranged to decrease in an outside diameter toward a rear of the intake case portion;

the suction tube portion is arranged radially inside of the intake case tubular portion, and is arranged to extend forward in an axial direction from a rear end portion of the intake case tubular portion;

the suction tube portion and the intake case tubular portion are arranged radially opposite to each other with a gap therebetween; and the gap is a portion of the expansion chamber.

9. The hair dryer according to claim 8, wherein the intake case tubular portion includes an annular portion arranged to extend radially inward;

the annular portion is arranged in the gap; and the suction tube portion is arranged radially opposite to the annular portion with a clearance space therebetween.

10. The hair dryer according to claim 8, further comprising a first sound absorber arranged in the gap.

11. The hair dryer according to claim 8, further comprising a second sound absorber arranged on an inner circumferential surface of the intake case tubular portion.

12. The hair dryer according to claim 1, wherein the suction tube portion includes a minute aperture arranged to pass therethrough in a radial direction to join the air inlet and the expansion chamber to each other.

13. The hair dryer according to claim 1, wherein the impeller is a centrifugal impeller or a mixed flow impeller;

at least a portion of an inner circumferential surface of the admission case portion is arranged to extend along a periphery of the impeller; and the admission case portion is arranged to gradually increase in an inside diameter in the forward direction from the admission inlet.

* * * * *